US008302639B2

(12) United States Patent
Jorgensen

(10) Patent No.: US 8,302,639 B2
(45) Date of Patent: Nov. 6, 2012

(54) PORTABLE BLENDING SYSTEM

(76) Inventor: Roy W. Jorgensen, Evansville, IN (US)

( * ) Notice: Subject to any disclaimer, the term of this patent is extended or adjusted under 35 U.S.C. 154(b) by 573 days.

(21) Appl. No.: 12/459,012

(22) Filed: Jun. 25, 2009

(65) Prior Publication Data

US 2009/0320957 A1 Dec. 31, 2009

Related U.S. Application Data

(60) Provisional application No. 61/133,059, filed on Jun. 25, 2008.

(51) Int. Cl.
*B67C 3/26* (2006.01)

(52) U.S. Cl. ..... 141/279; 141/59; 141/95; 141/100; 141/198; 141/231

(58) Field of Classification Search ..... 141/59, 141/95, 100, 101, 198, 231, 279, 284, 387
See application file for complete search history.

(56) References Cited

U.S. PATENT DOCUMENTS 4,796,678 A * 1/1989 Motohashi et al. ..... 141/206
6,082,392 A * 7/2000 Watkins, Jr. ..... 137/312
6,701,980 B2 * 3/2004 Rothrock ..... 141/231
6,945,288 B1 * 9/2005 Brakefield et al. ..... 141/231
7,308,918 B1 * 12/2007 Brakefield ..... 141/231
2004/0221918 A1 * 11/2004 Viegas et al. ..... 141/231
2004/0250871 A1 * 12/2004 Bingham et al. ..... 141/59
2009/0314384 A1 * 12/2009 Brakefield et al. ..... 141/67

* cited by examiner

*Primary Examiner* — Gregory Huson
*Assistant Examiner* — Jason K Niesz
(74) *Attorney, Agent, or Firm* — Gary K. Price

(57) ABSTRACT

A portable blending system that blends cleaner burning additives such as ethanol with unblended gasoline. Its portability enables locating the system at a user's site thereby enabling fuel blending at selected locations. The portable blending system includes a modular platform having a skid base that includes at least two longitudinally extending channels sized to accommodate a fork lift truck's forks, at least one feedpipe releasably attached to a user's storage tank that stores a selected liquid component such as ethanol or biodiesel, a loading arm assembly for transferring the selected liquid component to a tanker truck that stores a second liquid component such as a base gasoline, and electrical means having at least one conduit that connects the blending system to an external power source. The blending system can also includes a programmable logic controller, a vapor recovery adapter and an overfill monitor and overfill alarm.

17 Claims, 2 Drawing Sheets

PORTABLE BLENDING SYSTEM

CROSS REFERENCES TO RELATED APPLICATIONS

U.S. Provisional Application for U.S. Pat. No. 61/133,059, filed Jun. 25, 2008, with title "Apparatus for Storing and Blending Motor Fuel" which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

This invention relates generally to an apparatus of blending motor fuel and more particularly to a portable blending system having liquid blending capabilities.

2. Brief Description of Prior Art

The use of ethanol and biodiesel for example, have become an important consideration as a means of saving gasoline produced by high-cost crude oil. Growing requirements for motor fuel gasoline blends require systems that operate with minimum consumption and that are also reliable in continuous operation. Although liquid blending with gasoline has been practiced commercially to some extent during the past forty years, the use of such blends has been limited because of the relatively high costs of production.

Ethanol for example, or gasoline containing ethanol, cannot be moved practically through today's pipeline system, because it tends to get pulled into the water that usually exists in petroleum pipelines and tanks. Instead, ethanol is blended into gasoline at terminals preferably near the end user. Splash blending, in which ethanol is added directly to a tanker truck along with the base gasoline, is commonly used. Ethanol-blending product must be kept separate from product not containing ethanol, necessitating separate handling all the way to the gasoline pump. As a result, ethanol must be moved through an independent distribution system.

One of the main barriers to blending selected liquid components into unblended gasoline is the lack of facilities to receive, store and blend. The principal cost involved in the distribution of such blends is the construction of additional/separate storage and blending equipment at the oil company terminals, which cost is substantial. It can therefore be appreciated that there exists a continuing need for a new apparatus that in fact, receives, stores, and blends cleaner burning additives such as ethanol with unblended gasoline.

SUMMARY OF THE INVENTION

The present invention relates to a portable blending system that receives, stores, and blends cleaner burning additives such as ethanol with unblended gasoline. As will be understood, the present system enables fuel blending at selected locations near the end user's site. More particularly, the present invention discloses a portable apparatus that enables such blending capabilities at selected locations near the end user's bulk storage site. The portable blending system generally includes a modular platform having a platform surface, an at least one feeding pipe, a loading arm, electrical means, a controller, a vapor recovery adaptor, and an overfill monitor.

The blending system can further include a fill-spill containment box, a card reader, and an emergency shut off button. The blending system allows for easy installation, de-assembling, requiring minimal storage space for the blending operation, and at the same time cost effective. The system is designed to be readily transported to different locations where blending motor fuel is desired.

DESCRIPTION OF THE PREFERRED EMBODIMENT

Figure 1:
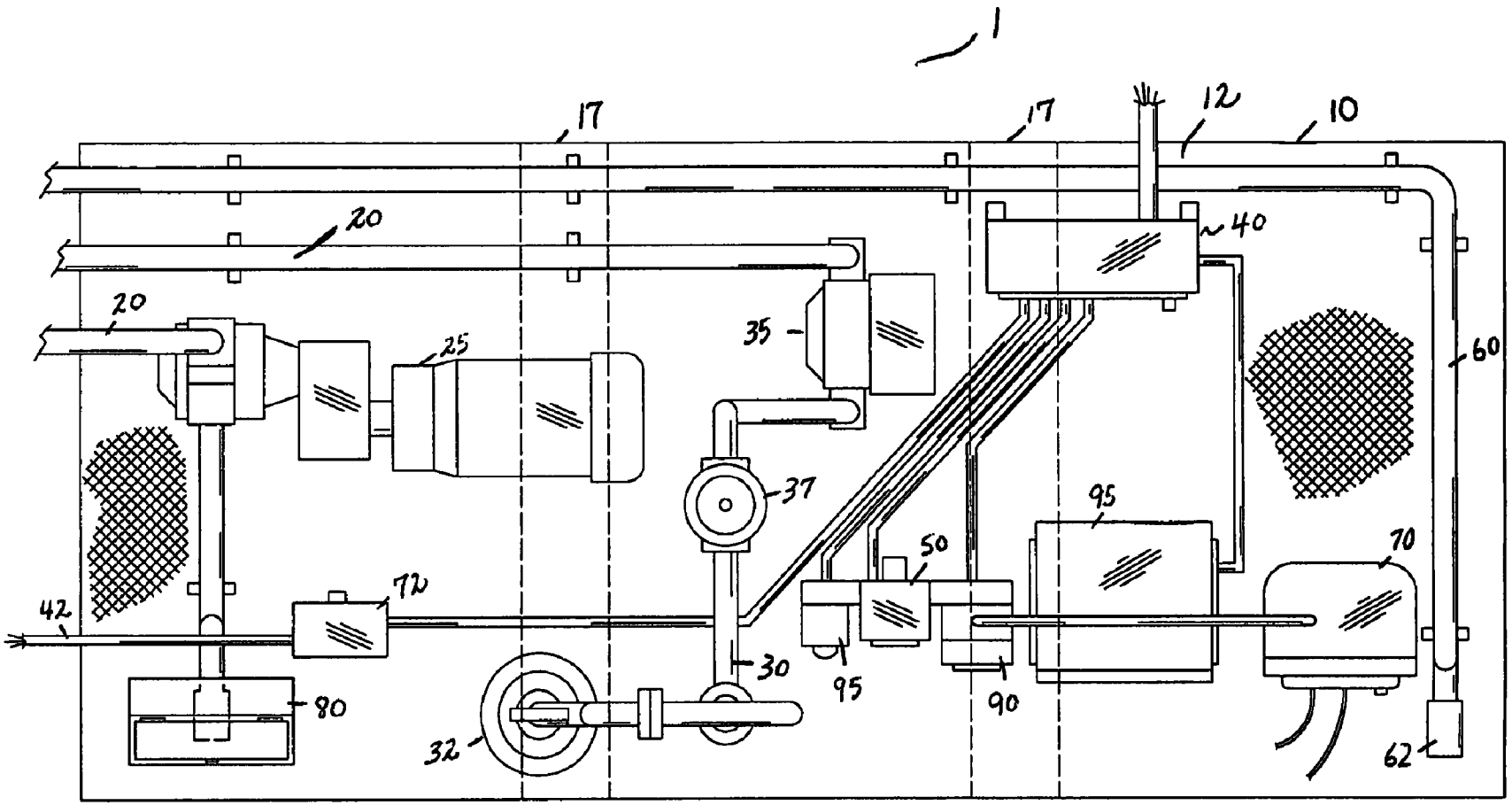
FIG. 1 is a top view of a preferred embodiment of the present invention, a portable blending system, with broken lines illustrating the location of the channels in the system's skid base.
Figure 2:
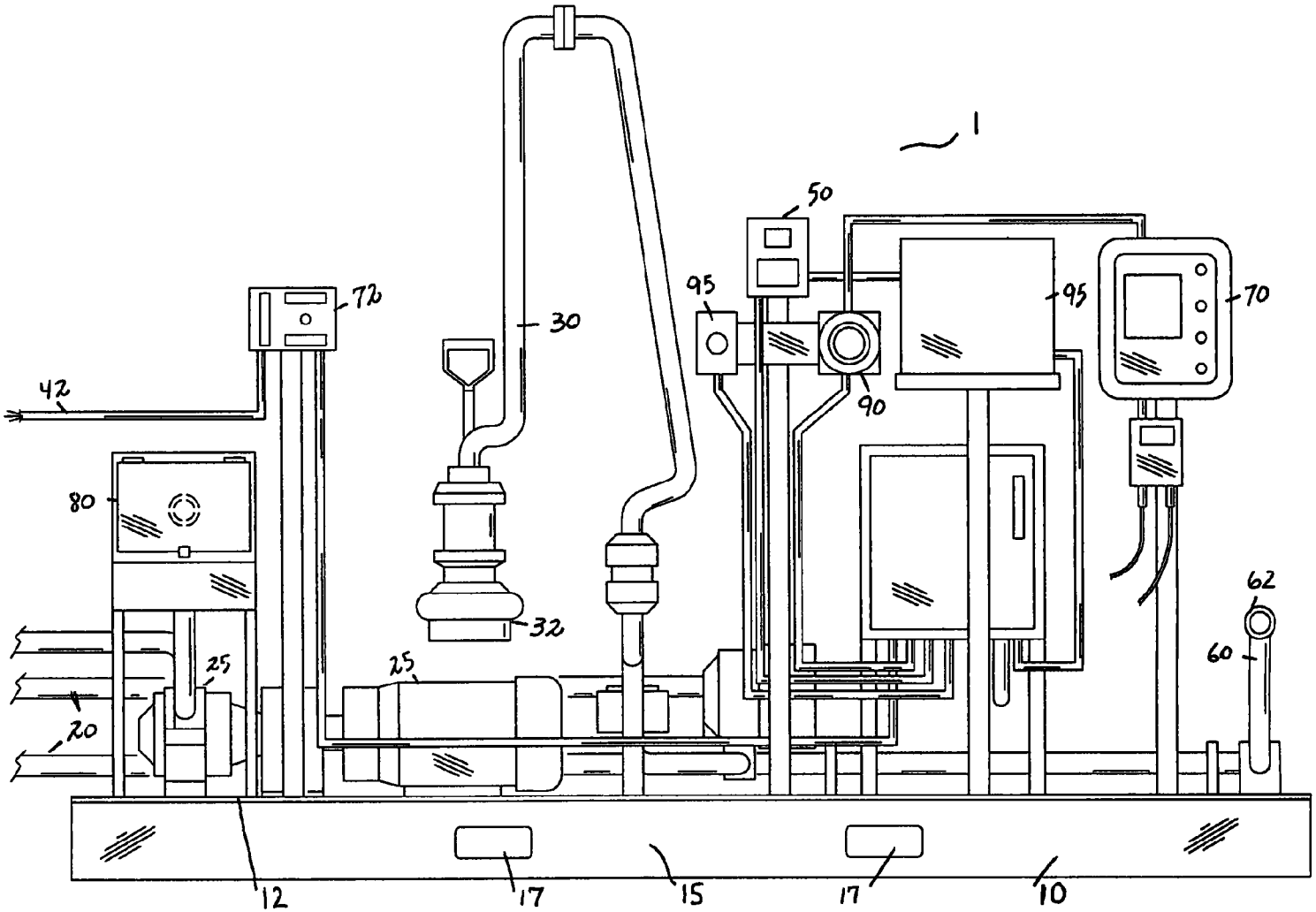
FIG. 2 is a side view of the portable blending system of FIG. 1.

The apparatus of the present invention is directed to an apparatus of blending motor fuel and more particularly to a portable blending system used with a bulk storing facility for blending an additive such as ethanol or biodiesel with unblended gasoline. The present invention discloses a portable apparatus that enables such blending capabilities at selected locations near the end user's bulk storage site. In the broadest context, the apparatus for storing and blending motor fuel as disclosed consists of components configured and correlated with respect to each other so as to attain the desired objective.

Referring to the drawings, the present invention discloses a portable blending system 1 that generally includes a modular platform 10 having a platform surface 12, an at least one feeding pipe 20, a loading arm 30, electrical means 40, a controller 50, a vapor recovery adaptor 60, and an overfill monitor 70. The apparatus of the present invention is a portable system that allows for easy installation, de-assembling, requiring minimal storage space for the blending operation, and at the same time cost effective. The system 1 is designed to be readily transported to different locations where blending motor fuel is desired and therefore enables fuel marketers to selectively locate the blending apparatus at or near the end user's site(s).

Platform

The platform 10 having the platform surface 12 further includes a skid base 15. The skid base 15 is supported on a ground surface (not shown). The skid base 15 preferably defines at least two longitudinally extending channels 17. The size of the channels 17, as well as the distance between the channels 17, are designed to accommodate the forks of a conventional fork lift truck. As such, the platform 10, having skid base 15 is designed to be lifted and transported and as a result, the blending system 1 of the present invention can be carefully controlled and positioned.

The platform surface 12 includes components that make-up a single workstation or terminal for blending selected liquid components with unblended gasoline. A discussion of those components are as follows:

Feeding Pipe

At least one additive feed pipe 20 is releasably attached to the user's storage tank (whether aboveground or underground) storing a selected liquid component such as ethanol or biodiesel. As will be understood the system 1 delivers the liquid component from the user's storage tank, through the feed pipe 20. More particularly, the system preferably delivers and adds the fuel additive through the feed pipe 20, directly to a tanker truck containing the base gasoline. The additive and bas gasoline are then blended using splash blending techniques.

A transfer pump 25 in communication with the feed pipe 20 is used to pump the additive from the storage tank, and through the feed pipe 20.

Loading Arm

The loading arm assembly 30 is especially suited for transferring the selected liquid component such as ethanol or biodiesel from the user's storage tank to the tanker truck containing the base gasoline. The loading arm assembly 30 includes a coupling connection 32, as is known in the art, for connecting the loading arm 30 to the tanker truck. In the preferred embodiment, the loading arm assembly 30 further includes a meter with pulsar assembly 35 that generates pulses with a width specific to the additive delivered to the tanker tank, and a digital preset valve 37 that controls the flow of fluid through the loading arm 30.

Electrical Means

The electrical means 40 provides power to the system 1. The electrical means 40 includes at least one power conduit 42 known in the art that connects to an external power supply to receive electrical power for the components of the system 1.

Controller

A programmable logic controller 50 generally records and controls all operations of the system 1. The controller 50 can be programmed to control and record any and all aspects of the system's operations. In this regard, the blending apparatus 1 is preferably under the continuous control of the controller 50, in order to properly deliver and blend the selected liquid component with the base gasoline to prescribe conditions. The data required for the controller 50 to properly blend as described, can also be used to generate useful operational data. For example, by monitoring the rate at which the additive component is drawn from the user's storage tank, one is better able to predict when the additive must next be purchased, and how much additive must be purchased, thereby ensuring better informed purchasing decisions. Moreover, by properly manipulating the data obtained from the controller 50, one is able to generate reports for additives such as ethanol or biodiesel sold or distributed from a particular site as may be required by federal and state laws or regulations.

The controller 50 can further be used to monitor, control and selectively change the ratio of additive component delivered with respect to the volume of the base component in the tanker truck.

Vapor Recovery Adaptor

The vapor recovery adaptor 60 is connected to the tanker truck while the truck tanker is receiving additive. As additive product is transferred from the user's storage tank into the truck tanker, the product vapor in the truck tanker is displaced, travelling through the vapor recovery adaptor 60 which then distributes the vapor to the various compartments of the truck. The vapor recovery adaptor 60 includes a coupling 62 for releasably attaching to the tanker truck.

Overfill Monitor

Truck tankers commonly include a sensor that generates a signal when the fluid level in the tank reaches a desired capacity. The overfill monitor 70 communicates with the truck tanker's overfill sensor and detects when the recipient tank is full or at its desired capacity and an overfill alarm 72 automatically disables the transfer process. Thus, waste is avoided and the environment is protected from spillage due to overfilling.

In addition to the components described, the system 1 can further include a fill-spill containment box 80, a card reader 90, a bill-of-lading ticket printer 95 and an emergency shut off button 95.

In use, the system 1 is positioned near or adjacent a storage tank containing the additive such as ethanol, to be blended with the unblended gasoline. A power source is connected to the system's electrical means 40 and, the at least one additive feed pipe 20 is appropriately connected to the user's storage tank.

When it is desired to deliver additive from the user's storage tank to the truck tanker, the system 1 is activated by engaging its power source. The controller 50 receives information relating to the fluid transfer by for example, scanning user information into the system with the system's card reader 90. Such user information may include the volume of additive, identification information relating to the user, the user identification, the truck tanker identification and the like.

Once the information is received and the system has recorded the volume of additive, the system delivers the liquid component from the user's storage tank, through the feed pipe 20, and directly to the tanker truck containing the base gasoline.

When it is desired to transport the portable blending system 1 to a different location, the user simply (1) disconnects the power source from the system's electrical means 40 and, (2) disconnects the system's at least one additive feed pipe 20 from the user's storage tank. The portable blending system 1 is then readily transported by a standard forklift truck by placing the forks thereof through the longitudinally extending channel 17 of the skid base 15. The portable blending system 1 can then be placed on the bed of a truck for example, for transport to the desired location.

Thus, it is apparent that there has been provided, in accordance with the invention, a portable blending system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

As such, it is to be understood that the present invention is not limited to the embodiments described above, but encompasses any and all embodiments within the scope of the claims.

I claim:

1. A blending system comprising:

a modular platform having a surface and a skid base, said skid base including at least two longitudinally extending channels, at least one feedpipe releasably attached to a user's storage tank that stores a selected liquid component, a loading arm assembly for transferring the selected liquid component from the blending system to a tanker truck that stores a base gasoline, electrical means having at least one conduit that connects the blending system to an external power source, a programmable logic controller to monitor, control and selectively change a volume of the selected liquid delivered with respect to a volume of the base gasoline in the tanker to create a desired fuel blend in said tanker, wherein said programmable logic controller is on said modular platform and said volume of the selected liquid delivered with respect to the volume of the base gasoline in the tanker is determined by data about said tanker entered into a card reader located on said modular platform, wherein said data includes data about said tanker, a vapor recovery adapter for connecting to said tanker and, an overfill monitor and overfill alarm.

2. The blending system as recited in claim 1, wherein said longitudinally extending channels having a size, and a distance between the channels, said size and distance to accommodate a fork lift truck's forks such that the blending system can be located at selected locations near an end user's site thereby enabling blending at the selected locations.

3. The blending system as recited in claim 1, further comprising at least one transfer pump in communication with said at least one feed pipe.

4. The blending system as recited in claim 1, wherein said loading arm assembly including a meter and pulsar assembly mounted on said modular platform and transportable.

5. A portable blending system for liquid blending, said portable blending system comprising:

a modular platform, at least one feedpipe releasably attached to a user's storage tank that stores a first liquid component, a loading arm assembly for transferring said first liquid component to an external storage tank that stores a second liquid component and, a programmable logic controller to monitor, control and selectively change a volume of said first liquid component delivered to a volume of said second liquid component to create a desired ratio of said first liquid component to said second liquid component in said external storage tank, and a programmable logic controller on said modular platform and wherein said ratio is determined by data about said external storage tank entered into a card reader located on said modular platform, and electrical means powering said controller and a transfer pump.

6. The portable blending system as recited in claim 5, wherein said platform includes a skid base, said skid base having at least two longitudinally extending channels.

7. The portable blending system as recited in claim 6, wherein said longitudinally extending channels having a size, and a distance between the channels, said size and distance to accommodate a fork lift truck's forks such that the portable blending system can be located at selected locations near an end user's site thereby enabling blending at the selected locations.

8. The portable blending system as recited in claim 7, further comprising a vapor recovery adapter for connecting to said external storage tank.

9. The portable blending system as recited in claim 8, further comprising an overfill monitor and overfill alarm.

10. The portable blending system as recited in claim 5, further comprising a transfer pump in communication with said feed pipe.

11. The portable blending system as recited in claim 5, wherein said electrical means includes at least one conduit that connects the portable blending system to an external power source.

12. The portable blending system as recited in claim 5, wherein said first liquid component is ethanol.

13. The portable blending system as recited in claim 5, wherein said first liquid component is biodiesel.

14. The system as recited in claim 5, wherein said second liquid component is unblended gasoline.

15. A portable blending system for liquid blending, said portable blending system comprising:

a modular platform having a skid base including at least two longitudinally extending channels having a size, and a distance between the channels, said size and distance to accommodate a fork lift truck's forks, at least one feedpipe releasably attachable to a user's storage tank that stores a first liquid component, a loading arm for transferring said first liquid component to an external storage tank that stores a different second liquid component and, electrical means having at least one conduit that connects the portable blending system to an external power source, a programmable logic controller to monitor, control and selectively change an amount of said first liquid component delivered to said second liquid component to create a desired ratio blend in said external storage tank by splash blending, wherein said at least one feedpipe, said loading arm, and said electrical means are affixed to a surface of said modular platform and wherein said logic controller is on said modular platform and wherein said ration blend is determined by data about said external storage tank entered by a user into a card reader located on said modular platform.

16. The portable blending system as recited in claim 15, wherein said first liquid component is ethanol.

17. The portable blending system as recited in claim 15, wherein said second liquid component is unblended gasoline and wherein said at least one conduit, said programmable logic controller, and said card reader are also mounted and transportable with said modular platform.

* * * * *